US006188850B1

(12) United States Patent
Sakaki et al.

(10) Patent No.: US 6,188,850 B1
(45) Date of Patent: Feb. 13, 2001

(54) PRINTING PAPER AND METHOD OF IMAGE FORMATION EMPLOYING THE SAME

(75) Inventors: Mamoru Sakaki, Yamato; Akio Suzuki, Yokohama; Masayoshi Takahashi, Chofu; Yoshinobu Shimomura, Yokohama; Tatsuo Takeuchi; Yoshihiro Takada, both of Kawasaki; Masato Katayama, Yokohama, all of (JP)

(73) Assignee: Canon Kabushiki Kaisha, Tokyo (JP)

( * ) Notice: Under 35 U.S.C. 154(b), the term of this patent shall be extended for 0 days.

(21) Appl. No.: 09/002,243

(22) Filed: Dec. 31, 1997

Related U.S. Application Data

(63) Continuation of application No. 08/334,014, filed on Nov. 2, 1994, now abandoned.

(30) Foreign Application Priority Data

Nov. 4, 1993 (JP) ..... 5-275521

(51) Int. Cl.[7] ..... G03G 15/00; G03G 21/00

(52) U.S. Cl. ..... 399/1; 428/341; 428/342

(58) Field of Search ..... 399/1; 428/211, 428/341, 342

(56) References Cited

U.S. PATENT DOCUMENTS

| | | | |
|---|---|---|---|
| 4,576,867 | 3/1986 | Miyamoto | 428/342 |
| 4,686,118 | 8/1987 | Arai et al. | 427/261 |
| 4,758,461 | 7/1988 | Akiya et al. | 428/212 |
| 4,785,313 | 11/1988 | Higuma et al. | 346/135.1 |
| 4,877,680 | 10/1989 | Sakaki et al. | 428/332 |
| 4,902,568 | 2/1990 | Morohoshi | 428/331 |
| 5,053,495 | 10/1991 | Greenwood et al. | 534/829 |
| 5,101,218 | 3/1992 | Sakaki et al. | 346/1.1 |
| 5,126,010 | 6/1992 | Kobayashi et al. | 162/135 |
| 5,180,624 | 1/1993 | Kojima et al. | 428/211 |
| 5,302,249 | 4/1994 | Malhotra et al. | 162/135 |
| 5,302,437 | 4/1994 | Idei et al. | 428/195 |
| 5,364,702 | 11/1994 | Idei et al. | 428/423.1 |
| 5,438,087 | 8/1995 | Ikeda et al. | 524/272 |
| 5,526,031 | 6/1996 | Kurabayashi | 347/105 |
| 5,620,793 | 4/1997 | Suzuki et al. | 428/342 |
| 5,648,164 | 7/1997 | Sakaki et al. | 428/341 |

FOREIGN PATENT DOCUMENTS

| | | |
|---|---|---|
| 28720 | 5/1981 | (EP) . |
| 379978 | 8/1990 | (EP) . |
| 2211866 | 7/1989 | (GB) . |
| 51-13244 | 2/1976 | (JP) . |
| 54-59936 | 5/1979 | (JP) . |
| 59-35977 | 2/1984 | (JP) . |
| 59-162561 | 9/1984 | (JP) . |
| 59-191068 | 10/1984 | (JP) . |
| 1-135682 | 5/1989 | (JP) . |
| 3-62042 | 3/1991 | (JP) . |

OTHER PUBLICATIONS

Database WPI, n 87–216231, Derwent Publications Ltd., GB; & Abstract of JP–A–62140877 (Canon KK) Jun. 24, 1987.

European Patent Office Abstract No. 93–149386 [18] for Japanese Patent No. 5086314 (Apr. 6, 1993).

European Patent Office Abstract No. 93–024441 [03] for Japanese Patent No. 4353862 (Dec. 8, 1992).

European Patent Office Abstract No. 87–097909 [14] for Japanese Patent No. 62045799 (Feb. 27, 1987), and Ura et al., Abstract No. 5169, 1004 Abstract Bulletin.

Patent Abstracts of Japan, vol. 8, No. 132 (M–303) (1569), Jun. 20, 1984 for Japanese Patent No. 59033176.

Patent Abstracts of Japan, vol. 10, No. 242, (M–509) (2298), Aug. 21, 1986 for Japanese Patent No. 61072581.

*Primary Examiner*—Fred L. Braun
(74) *Attorney, Agent, or Firm*—Fitzpatrick, Cella, Harper & Scinto

(57) ABSTRACT

A neutralized printing paper which is made of a base paper and a cationic compound applied on a printing surface of the base paper. The paper has a surface pH value ranging from 6.0 to 7.5.

16 Claims, 3 Drawing Sheets

PRINTING PAPER AND METHOD OF IMAGE FORMATION EMPLOYING THE SAME

This is a continuation of application Ser. No. 08/334,014 filed on Nov. 2, 1994 and now abandoned.

BACKGROUND OF THE INVENTION

1. Field of the Invention

The present invention relates to a printing paper which is based on neutralized paper and exhibits excellent performance as toner-transfer paper for electrophotographic printing, and also relates to a method of image formation by electrophotographic printing by use of this printing paper.

The present invention further relates to a printing paper which is based on neutralized paper and is capable of forming sharp images in ink-jet recording, and also relates to a method of image formation by ink-jet printing by use of this printing paper.

2. Related Background Art

An electrophotographic copying machine is exemplified by a copying machine which conducts printing through the process of: charging a photoconductive photosensitive member by means of a temporary electric charger; exposing the photosensitive member to light to form a latent image; developing the latent image with a developing toner of the one- or two-component type, transferring the toner image from the photosensitive member to a printing paper sheet fed from the outside by means of a toner-transfer electric charger, and fixing the transferred toner on the printing paper sheet by action of heat and/or pressure by means of a fixing roller or the like to obtain a final copied image.

The properties required for the transfer paper for such a copying machine are as follows:

(1) optimum surface electrical resistance and optimum surface smoothness and good toner transfer property, (2) excellent in toner-fixing properties, (3) less paper dust formation, i.e., causing no image defect due to of the formed paper dust sticking to a photosensitive member, an electric charging roller, etc., (4) the formed dust (filler, etc.) does not scrape or abrade the photosensitive member, the paper-delivering roller, fixing rolls, etc., (5) generating no curling by action of heat, (6) generating no variation of the paper dimension by humidity change, (7) low stiffness, and optimum surface friction coefficient and excellent deliverability.

In recent years, neutralized paper has come to be used widely in place of conventional acidic paper for storability of the paper and other reasons. Japanese Patent Application Laid-open No. 59-191068 discloses toner-transfer paper suitable for electrophotographic printing.

On the other hand, the ink-jet printing system is attracting attention because of ease of high speed printing, color printing, and high-density printing, and therefore the ink-jet printing apparatus has come to be widely used. In particular, for mono-color printing and business color printing, ink-jet printing is required to be suitable for printing on inexpensive ordinary paper which is available in offices, not on paper exclusively for use in ink-jet printing.

No toner-transfer paper is presently known which is suitable also for ink-jet printing.

When the toner-transfer paper, which is neutralized paper, is used for ink-jet printing, disadvantages are involved such as insufficient ink-fixing properties, insufficient water fastness of the printed image owing to water-soluble printing agent, and insufficient coloring ability of the coloring agent.

SUMMARY OF THE INVENTION

The present invention intends to provide a printing paper which comprises neutralized paper as the base material and satisfies the requirements for a toner-transfer paper for electrophotographic printing, in particular, having excellent toner fixation properties, and is also useful for ink-jet printing without the above-mentioned disadvantages.

The present invention also intends to provide a method for forming an image on the aforementioned printing paper by electrophotographic printing as well as by ink-jet printing.

The object mentioned above can be achieved by the present invention.

According to the present invention, there is provided a printing paper which is neutralized paper comprising a cationic compound on a printing surface of a base paper, and having a surface pH value ranging from 6.0 to 7.5. The printing paper is coated with a material containing a substance which lowers the surface pH value of the base paper, and has a Stoeckigt sizing degree ranging from 16 to 40 seconds.

According to the present invention, there is also provided an image-forming method comprising the steps of developing an electrostatic image by a developing means with a toner, transferring a toner image developed on a photosensitive member onto a transfer-receiving material by a transfer means, and fixing the image formed on the transfer-receiving material by heat and/or pressure with a pair of rollers to form a fixed image, the transfer-receiving material being the above-defined printing paper.

According to the present invention, there is further provided an image-forming method which is an ink-jet printing method to conduct printing by applying an ink comprising a dye, a low-boiling solvent, a non-volatile solvent, and a nitrogen-containing compound to the above-defined printing paper.

DESCRIPTION OF THE PREFERRED EMBODIMENTS

Figure 1:
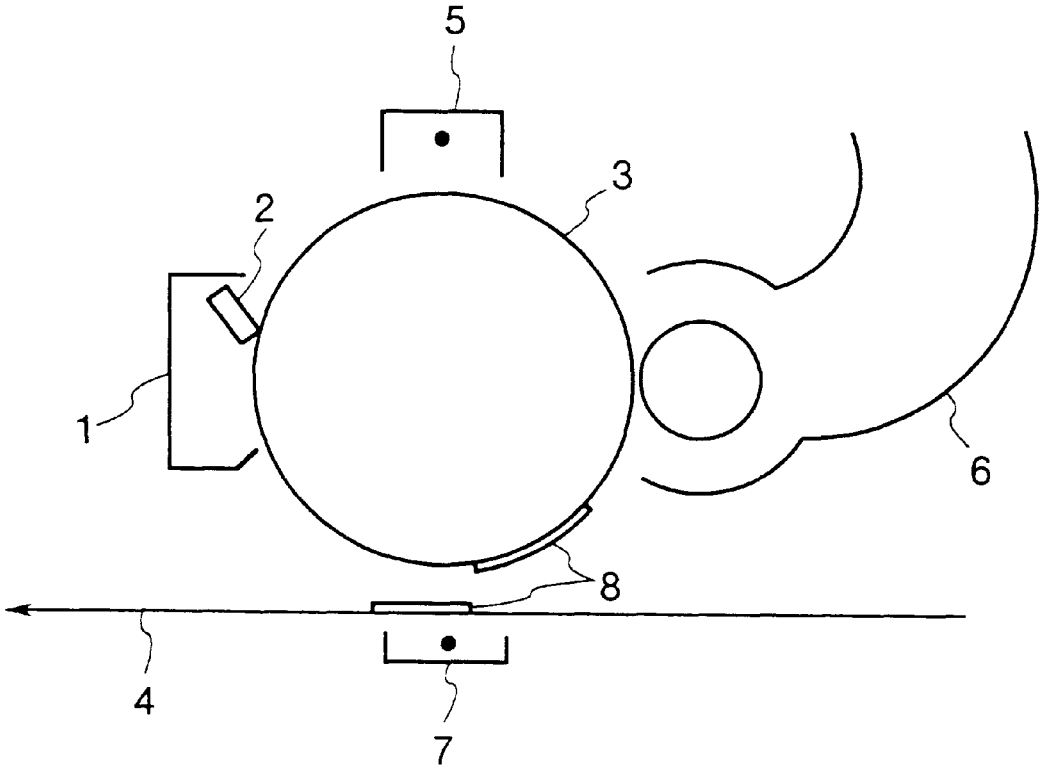
FIG. 1 illustrates an example of a printing means of electrophotographic copying machines.

After comprehensive studies, it has been found by the inventors of the present invention that toner-transfer paper based on neutralized paper has excellent electrophotographic printing characteristics, in particular, excellent toner fixing properties, and yet has excellent ink-jet printing characteristics such as sufficient ink-fixing properties with high water-fastness of the printed image and sufficient coloring ability of a coloring agent, by applying a cationic resin on a surface by means of a size press coating and adjusting a surface pH value within a specified range.

The printing paper employed in the present invention is made by a conventional paper-making process from chemical pulp represented by LBKP, NBKP, etc., a sizing agent, and a filler as the main components and additionally necessary paper-making auxiliary agents. The pulp may be mechanical pulp, a regenerated waste paper, or combination thereof.

The sizing agent includes rosin sizes, alkyl ketene dimers, alkenylsuccinic anhydrides, petroleum resin sizes, epichlorohydrin, acrylamide, etc.

The filler includes calcium carbonate, kaolin, talc, titanium dioxide, etc.

In producing the printing paper of the present invention, the pulp slurry prepared by dispersing the above materials is adjusted to have a pH of about 7 or higher, due to no use of aluminum sulfate as a fixing agent for the sizing agent, or the use thereof as little as possible.

The printing paper of the present invention is obtained by treating the above-produced paper for size press coating as usual with starch or the like in order to improve the surface strength and writing quality of the paper.

The surface pH value of the printing paper is adjusted finally by the aforementioned size press coating in the present invention. The sizepress coating solution contains preferably a substance for lowering the surface pH value of the base paper, more preferably a cationic compound, to adjust the pH within the above-mentioned range.

The cationic compound in the present invention means a compound which has, in the main chain or the side chain thereof, a functional group such as primary, secondary, and tertiary amino, quaternary ammonium, pyridyl, pyridinium, imidazolyl, imidazolinium, sulfonium, phosphonium, and the like, preferably strong acid salts thereof. Such cationic compounds include homopolymers of cationic vinyl compounds such as polyvinylamine, polyallylamine, polydiallylamine, polydimethylaminoethyl methacrylate and salts thereof; and cation-modified polyvinyl alcohol, polyvinyl-pyrrolidone, polyacrylamide, etc. modified by partially copolymerizing the above functional vinyl monomer with another vinyl monomer; cationized hydroxyethylcellulose, and cationized starch.

The properties of printing paper of the present invention are controlled as follows.

The surface electric resistance is in the range of from $10^9$ to $10^{12}\Omega$. The surface electric resistance outside this range causes incomplete toner transfer, toner stains on white portions of the print, which is called fogging.

In view of the deliverability of the paper and its curling tendency, the paper is controlled to have basis weight in the range of from 60 to 90 g/m$^2$, density in the range of from 0.6 to 0.8 g/m$^3$, water content of the wet web in paper-making in the range of from 3.5 to 7% by weight, stiffness in the range of from 50 to 130 cm$^3$/100 in the MD direction, and from 25 to 100 cm$^3$/100 in the CD direction.

The whiteness degree of the paper is not lower than 75%, and the opacity thereof is not lower than 80%.

The surface electric resistance is measured according to JIS-C-2111 (20° C./65% RH), the basis weight according to JIS-P-8124, the density according JIS-P-8118, the water content according to JIS-P-8127, the stiffness according to JIS-P-8143, the whiteness degree according to JIS-P-8123, and the opacity according to JIS-P-8138.

The Stoeckigt sizing degree of the printing paper of the present invention is preferably in the range of from 16 to 40 seconds. When a printing paper of a Stoeckigt sizing degree of lower than 16 seconds is used for ink-jet printing, the ink is liable to run on the paper surface, and feathering of the printed dots and broadening of printed lines are liable to occur, impairing the printed character quality. On the other hand, with a printing paper of a Stoeckigt sizing degree of higher than 40 seconds, ink absorbency is not sufficient, and requires a long time for drying of the ink at the printed portion, and the printed image quality is liable to be impaired by smearing before drying of the ink.

Figure 2:
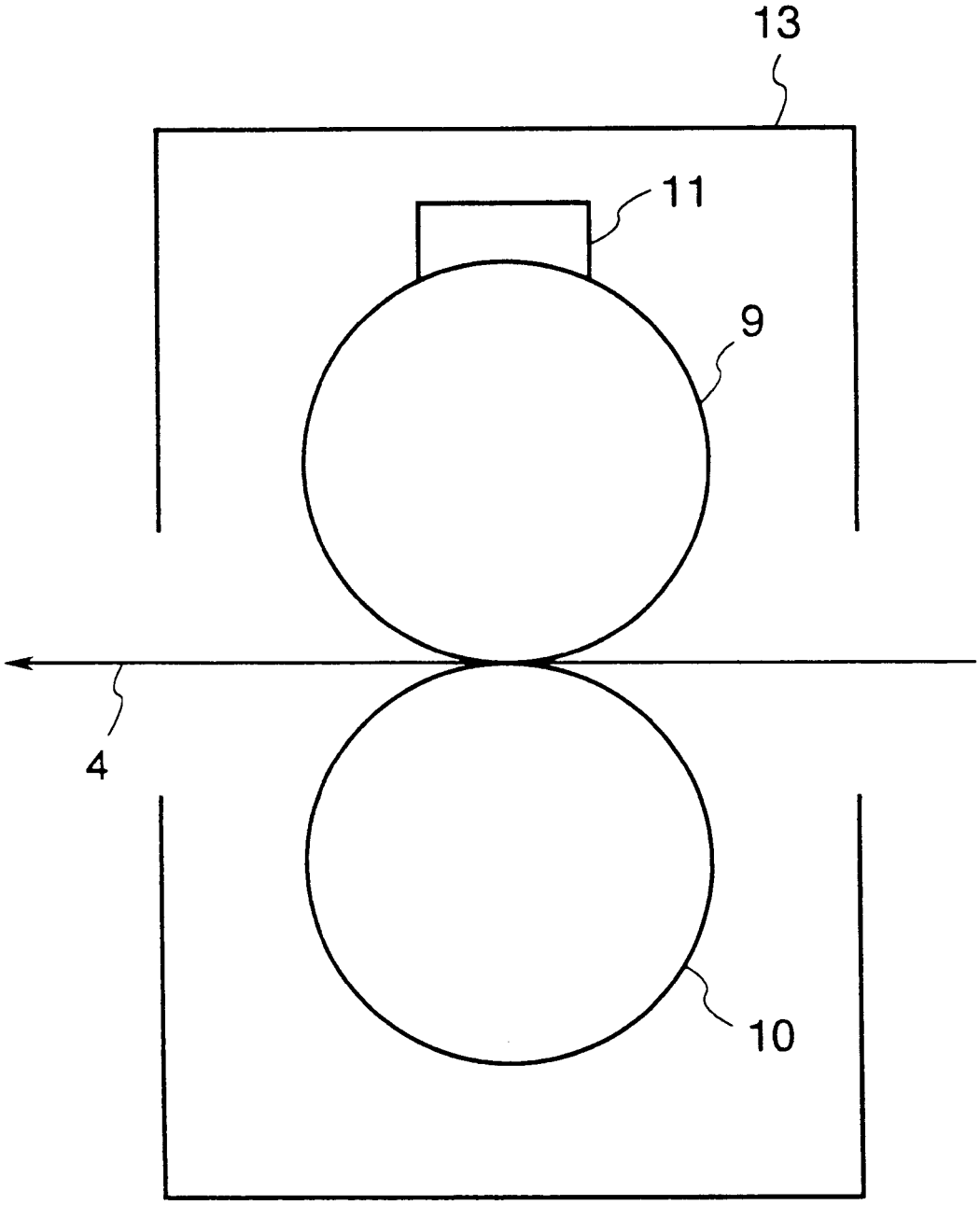
FIG. 2 illustrates an example of fixation devices of electrophotographic copying machines.

FIG. 1 illustrates an example of the printing means of an electrophotographic copying machine. A photoconductive photosensitive member 3 is electrically charged by means of a temporary electric charger 5. Then the charged sensitive member is exposed to light imagewise to form a latent image. The latent image is developed with a one- or two-component type toner 8 which is held in a developer 6 as the developing means to form a toner image. The toner image on the photosensitive member is transferred onto a printing paper sheet 4 fed from the outside, with a transfer charger 7 as the transfer means. Then, the toner image on the printing paper 4 is fixed by heat and/or pressure with a fixing device 13 as the toner device as shown in FIG. 2 which has a pair of rollers 9 and 10 (or one roller with one belt). Thus the final copied image is obtained. In the transfer process, unfixed toner and paper dust formed from the printing paper sheet 4 are removed to clean the photosensitive member 3 by a cleaner device 1 placed after the transfer step. After the cleaning with a cleaning member 2 (e.g., a cleaning blade) in contact with the photosensitive member 3, the surface of the photosensitive member is repeatedly subjected to the steps of charging, etc. In the fixing device 13, as shown in FIG. 2, the unfixed toner and the paper dust from the transfer paper 4 on the fixation roller 9 are removed with the cleaning member 11 brought into contact therewith and simultaneously a releasing agent such as silicone oil is applied to the roller.

Figure 3:
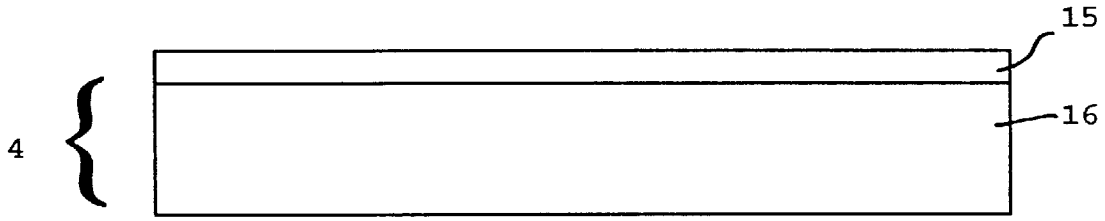
FIG. 3. illustrates an example of a printing paper sheet according to the invention.

FIG. 3 illustrates an example of a printing paper sheet according to the invention. A cationic compound 15 is applied to a surface of a base paper 16.

Next, the ink-jet printing system is described. In the ink-jet printing system, ink is effectively ejected from a nozzle onto a printing paper placed at a distance within the ink-shooting range. A typical example is disclosed in Japanese Patent Application Laid-open No. 54-59936, in which ink receives thermal energy to change its volume abruptly by bubbling and the change of the state gives driving force to eject the ink from the nozzle.

The ink employed for ink-jet printing contains as the printing agent a water-soluble dye, e.g., direct dyes, acid dyes, basic dyes, reactive dyes, and food colors, etc., a disperse dye, a pigment, or the like. Of these, acid dyes and direct dyes are widely used. Such a printing agent is contained in the ink in an amount of from about 0.1 to about 20% by weight of the ink. The solvent for the ink is usually water or a mixed solvent of water with a water-soluble organic solvent. Particularly preferred solvents are mixed solvents composed of water and water-soluble organic solvents, containing a polyhydric alcohol and the like which are effective for prevention of drying of the ink. The ink which contains an acid dye or a direct dye usually contains as the dissolution aid for the dye a nitrogen compound such as ammonia (ammonium ion), urea or its derivative, an aminoalcohol, an alkylamine, and an amino acid.

The printing paper of the present invention has suitability for mono-color types of ink-jet printing. It is particularly suitable for a printing system employing an ink which contains a black dye shown below and a nitrogen-containing compound as a dissolution aid.

(1)
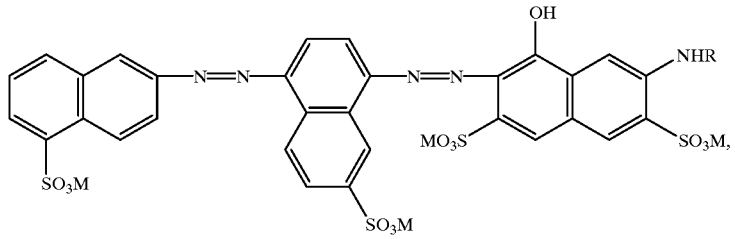
(2)
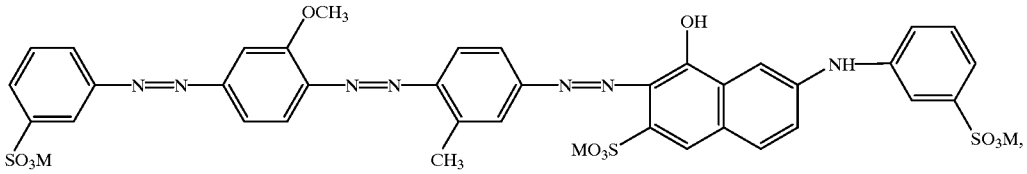
(3)
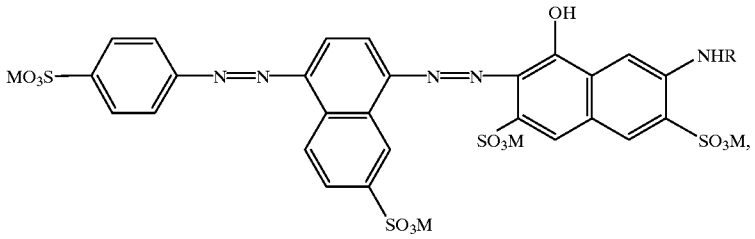
(4)
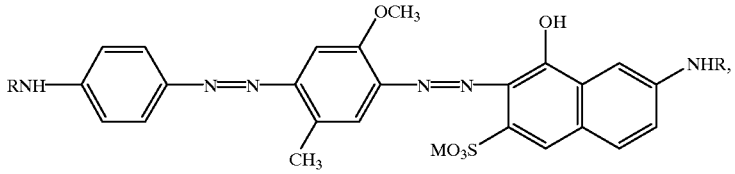
(5)
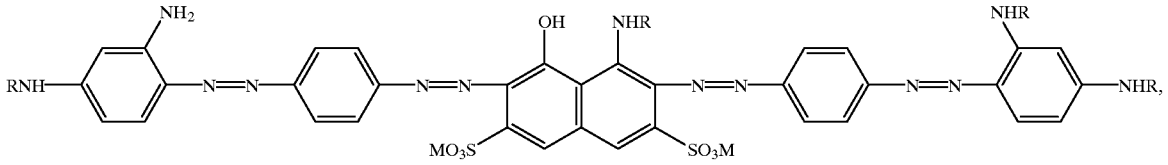
(6)
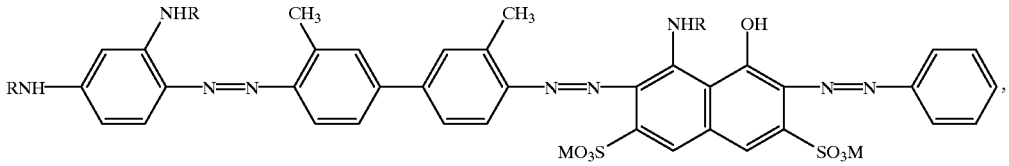
(7)
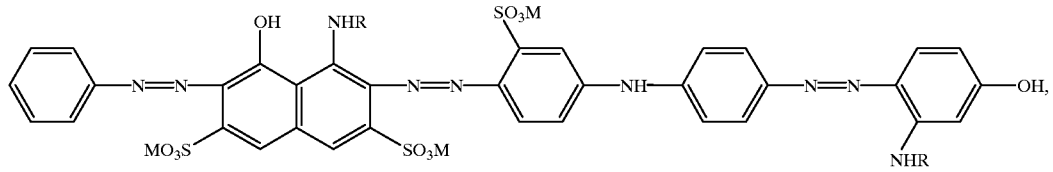

-continued (8)

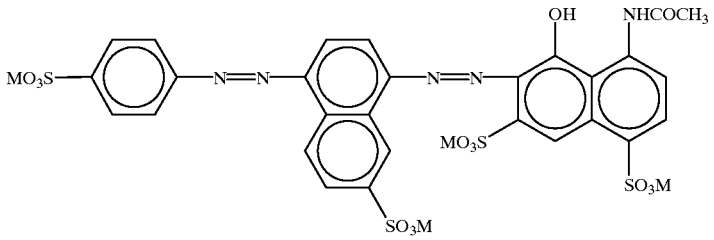

and (9)

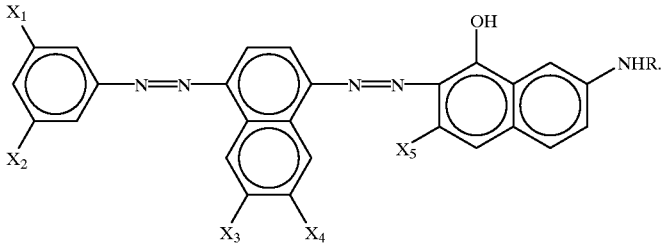

In the formulas, M is Na or Li; R is H or alkyl; $X_1$ to $X_5$ are independently H, $SO_3Y_1$ or $COOY_2$, $Y_1$ and $Y_2$ are independently Na, Li, K, or $NH_4$.

The present invention is described in more detail by reference to examples. In the following, "part" or "parts" is by weight unless otherwise noted.

[Preparation of Printing Paper (1)]

A mixture of 90 parts of LBKP and 10 parts of NBKP was used as the pulp material. The mixture was subjected to beating treatment. Thereto were added calcium carbonate, (Escalon, produced by Sankyo Seifun K.K.) as the filler, and an alkylketene dimer and a cationic starch as additives. The mixture was subjected to paper-making in a conventional manner to obtain a base paper sheet having a basis weight of 64 g/m$^3$ and Stoeckigt sizing degree of 18 seconds. To the base paper sheet, 2% oxidized starch aqueous solution was applied as the coating solution by means of a size press coating to obtain Printing Paper Sheet 1. Further, Printing Paper Sheets 2 through 4 were prepared from sizepress coating solutions having each composition mentioned below by size press. The surface pH values of the Printing Paper Sheets are shown in Table 1.

[Preparation of Printing Paper (2)]

A base paper sheet for printing was prepared in the same manner as above except that kaolin was used as the filler and neutral rosin size (Sizepine NT, produced by Arakawa Kagaku K.K.) was used in place of the alkylketene dimer. The base paper sheet had a basis weight of 67 g/m$^2$, and a Stoeckigt sizing degree of 16 seconds. On the base paper sheet, the same coating solution as the one for Printing Paper Sheet 1 was applied to obtain Printing Paper Sheet 5. By application of the sizepress coating solutions having the compositions stated below by a size press coating, Printing Paper Sheets 6 through 8 were obtained. The surface pH values of the respective paper sheets are shown in Table 1.

| <Composition of Sizepress Coating Solution for Printing Paper Sheets 2 to 4> | |
|---|---|
| Oxidized starch (MS-3800, produced by Nippon Shokuhin K.K.) | 2 parts |
| Polyamine sulfone (PAS-H,10 L produced by Nittobo K.K.) | X parts |
| Water | 98-X parts |
| Printing Paper Sheet 2: X = 0.06 | |
| Printing Paper Sheet 3: X = 0.2 | |
| Printing Paper Sheet 4: X = 1.5 | |

| <Composition of Sizepress Coating Solution for Printing Paper Sheets 6 to 8> | |
|---|---|
| Oxidized starch (MS-3800, produced by Nippon Shokuhin K.K.) | 2 parts |
| Polyallylamine hydrochloride (PAAHCL, 10 L produced by Nittobo K.K.) | X parts |
| Water | 98-X parts |
| Printing Paper Sheet 6: X = 0.04 | |
| Printing Paper Sheet 7: X = 0.1 | |
| Printing Paper Sheet 8: X = 1 | |

[Evaluation of Electrophotographic Printing Suitability]

The suitability for electrophotographic printing was evaluated with the copied image quality formed by use of Copying Machine NP-9800, and Color Copying Machine CLC-500 (respectively trade names, manufactured by Canon K.K.) having an image forming device and a fixing device as shown in FIGS. 1 and 2. The evaluation results are shown in Table 1 as three grades:

a: Good (good color tone, color reproducibility, and coloration);

b: Fair; and c: Poor (dull coloration, blank portions found).

[Evaluation of Ink-Jet Printing Suitability]

The suitability for ink-jet printing was evaluated by printing with the inks below by means of an ink-jet printing apparatus having an ink-jet printing head comprising 14 printing nozzles per mm to eject ink droplets by action of thermal energy. The ink used and the evaluation items are shown below:

| <Ink Composition> | |
|---|---|
| Dye | 3 parts |
| Glycerol | 6 parts |
| Ethanol | 6 parts |
| Urea | 6 parts |
| Water | 79 parts |

B: Medium (worse, than A but better than X); and

X: Printed area being recognized as dark brown.

(4) Character quality

A: Printed characters "a, b, c" in size of 3×3 mm having sharp edge; and

X: Above printed characters having unclear edge, or undecipherable.

(5) Rub fastness

The printed matter, 15 seconds after printing, is rubbed with Silbon C paper (trade name) with load of 40 gf/cm$^2$.

A: No smearing observed; and

X: Smearing observed.

TABLE 1

| Printing paper No. | Surface pH | Sizing degree (sec) | EPG* suit-ability | Ink-jet recording suitability: Ink I Image density | Ink I Water fastness | Ink I Color tone | Ink I Character quality | Ink I Rub fastness | Ink II Image density | Ink II Water fastness | Ink II Color tone | Overall eval-uation | Note** |
|---|---|---|---|---|---|---|---|---|---|---|---|---|---|
| 1 | 8.6 | 18 | c | 1.38 | C | X | A | A | 1.34 | X | X | Poor | CE-1 |
| 2 | 7.3 | 18 | b | 1.42 | B | B | A | A | 1.38 | C | B | Good | E-1 |
| 3 | 6.5 | 18 | a | 1.43 | B | A | A | A | 1.33 | C | A | Good | E-2 |
| 4 | 4.6 | 18 | a | 1.22 | B | X | A | A | 1.18 | C | B | Poor | CE-2 |
| 5 | 8.0 | 16 | c | 1.41 | C | B | A | A | 1.37 | X | A | Poor | CE-3 |
| 6 | 7.2 | 16 | a | 1.41 | B | A | A | A | 1.36 | B | A | Good | E-3 |
| 7 | 6.2 | 16 | a | 1.39 | A | A | A | A | 1.33 | B | A | Good | E-4 |
| 8 | 3.6 | 16 | a | 1.26 | A | X | A | A | 1.21 | B | X | Poor | CE-4 |

*Electrophotographic printing suitability
**E-: Example No., CE-: Comparative Example No.

Ink I: The previously mentioned exemplified dye of Formula (9) was used (in the formula, $X_1$ is $COONH_4$; $X_2$ is $COONH_4$; $X_3$ and $X_4$ are H; R and $X_5$ are H).

Ink II: A mixture (mixing ratio 1:1) of the previously mentioned exemplified dyes of Formula (1) and Formula (2) was used (in the formulas, M is Li; and R is H).

[Evaluation Items]

(1) Image density:

A black solid print image is formed by use of the aforementioned printing apparatus, and the density of the solid printing is measured by a MacBeth densitometer (RD-918).

(2) Water fastness:

Printing is conducted by use of the aforementioned printing apparatus. One hour after the printing, the printed matter is immersed in tap water for 3 seconds and is dried spontaneously. After drying, the water fastness is evaluated as one of four grades:

A: No change of image observed;

B: No change observed in printed area, slight tailing to non-printed area observed (re-adhesion of released dye);

C: Printed area blurred, tailing to non-printed area significant; and

X: Printed characters not decipherable.

(3) Black color tone

A: Printed area being recognized as black in the same area as the measurement of the image density;

The printing paper of the present invention is a neutralized paper formed to have the aforementioned excellent properties and to be suitable for electrophotographic copying, further having a surface pH value adjusted to 6.0 to 7.5 by a sizepress coating containing a strong acid salt of a cationic compound. Such toner-transfer paper satisfies the various requirements of electrophotographic printing suitability and is excellent in toner fixing properties and paper deliverability.

Furthermore, the printing paper of the present invention is excellent in printing suitability also for mono- or multi-color ink jet printing, exhibiting excellent coloring properties of the printing agent, and giving images with sufficient density and black tone. In particular, the printing paper of the present invention is satisfactory in comparison with conventional neutralized paper having a higher surface pH which is insufficient in water-fastness and black tone of the images.

What is claimed is:

1. A neutralized printing paper comprising a base paper and a cationic compound and starch applied on a printing surface of the base paper, and having a surface pH value ranging from 6.0 to 7.5, and a Stöckigt sizing degree of from 16 to 40 seconds, wherein the pH value of an interior of the neutralized printing paper is not lower than the surface pH value, and wherein the cationic compound is a strong acid salt of a compound having a functional group selected from the group consisting of primary, secondary, and tertiary amino, quaternary ammonium, pyridyl, pyridinium, imidazolyl, imidazolinium, sulfonium, and phosphonium.

2. The printing paper according to claim 1, wherein said cationic compound is selected from the group consisting of strong acid salts of polyvinylamine, polyallylamine, polydiallylamine and polydimethylaminoethyl methacrylate.

3. The printing paper according to claim 1, which has a surface electric resistance ranging from $10^9$ to $10^{12}\Omega$.

4. The printing paper according to claim 1, which has a basis weight of from 60 to 90 $g/m^2$.

5. A neutralized printing paper according to claim 1, which has a density ranging from 0.6 to 0.8 $g/m^3$.

6. A neutralized printing paper according to claim 1, which has a stiffness ranging from 50 to 130 $cm^3/100$ in the MD direction.

7. A neutralized printing paper according to claim 1, which has a stiffness ranging from 25 to 100 $cm^3/100$ in the CD direction.

8. A neutralized printing paper according to claim 1, which has a whiteness degree of not lower than 75%.

9. A neutralized printing paper according to claim 1, which has an opacity of not lower than 80%.

10. The printing paper according to claim 1, wherein the base paper contains kaolin as a filler and a rosin size as a sizing agent.

11. An image-forming method comprising the steps of developing an electrostatic image by a developing means with a toner, transferring a toner image developed on a photosensitive member onto a transfer-receiving material by a transfer means, and fixing the image formed on the transfer-receiving material by heat and/or pressure with a pair of rollers to form a fixed image, said transfer-receiving material being the printing paper as defined in any one of claims 1 to 10.

12. An image forming method, which is an ink-jet printing method to conduct printing by applying an ink comprising a dye, a low-boiling solvent, a non-volatile solvent, and a nitrogen-containing compound to a printing paper, wherein said printing paper is as defined in any one of claims 1 to 10.

13. The image-forming method according to claim 12, wherein said ink-jet printing method is of a type in which ink droplets are ejected from orifices by imparting thermal energy to the ink.

14. A process for preparing a neutralized printing paper comprising the steps of:

providing a base paper having a pH value, and applying onto the base paper a coating solution which comprises a cationic compound and which has a pH value smaller than the pH value of the base paper, wherein the cationic compound is a strong acid salt of a compound having a functional group selected from the group consisting of primary, secondary, and tertiary amino, quaternary ammonium, pyridyl, pyridinium, imidazolyl, imidazolinium, sulfonium, and phosphonium.

15. An image-forming method comprising the steps of developing an electrostatic image by a developing means with a toner, transferring a toner image developed on a photosensitive member onto a transfer-receiving material by a transfer means, and fixing the image formed on the transfer-receiving material by heat and/or pressure with a pair of rollers to form a fixed image, said transfer-receiving material being the printing paper prepared by the process according to claim 14.

16. An image-forming method, which is an ink-jet printing method to conduct printing by applying an ink comprising a dye, a low-boiling solvent, a non-volatile solvent, and a nitrogen-containing compound to a printing paper, wherein said printing paper is prepared by the process according to claim 14.

* * * * *

UNITED STATES PATENT AND TRADEMARK OFFICE

CERTIFICATE OF CORRECTION

PATENT NO. : 6,188,850 B1
DATED : February 13, 2001
INVENTOR(S) : Mamoru Sakaki et al.

It is certified that error appears in the above-identified patent and that said Letters Patent is hereby corrected as shown below:

Column 1,
Line 40, "of" should be deleted.

Column 9,
Line 65, "tone" should read -- tone: --.

Column 10,
Line 1, "(worse," should read -- (worse --.
Line 3, "quality" should read -- quality: --.
Line 8, "fastness" should read -- fastness: --.
Line 46, "ink jet" should read -- ink-jet --.

Signed and Sealed this

Ninth Day of April, 2002

*Attest:*

*Attesting Officer*

JAMES E. ROGAN
*Director of the United States Patent and Trademark Office*